US008684290B1

(12) United States Patent
Allerton

(10) Patent No.: US 8,684,290 B1
(45) Date of Patent: Apr. 1, 2014

(54) PILL CRUSHING DEVICE AND SYSTEM

(71) Applicant: George L. Allerton, Orefield, PA (US)

(72) Inventor: George L. Allerton, Orefield, PA (US)

( * ) Notice: Subject to any disclaimer, the term of this patent is extended or adjusted under 35 U.S.C. 154(b) by 0 days.

(21) Appl. No.: 13/730,186

(22) Filed: Dec. 28, 2012

Related U.S. Application Data

(60) Provisional application No. 61/580,976, filed on Dec. 28, 2011.

(51) Int. Cl.
*B02C 19/00* (2006.01)

(52) U.S. Cl.
USPC ..... 241/27; 241/169; 241/283; 241/DIG. 27

(58) Field of Classification Search
USPC ..... 81/27; 241/DIG. 27, 168, 169, 169.2, 241/283, 27
See application file for complete search history.

(56) References Cited

U.S. PATENT DOCUMENTS

| | | | | | |
|---|---|---|---|---|---|
| 2,928,444 | A * | 3/1960 | Ivins | 81/22 |
| 5,239,918 | A * | 8/1993 | Whaling | 99/571 |
| 5,478,311 | A * | 12/1995 | Klearman | 604/82 |
| 5,546,832 | A * | 8/1996 | Townsend | 81/25 |
| 5,863,001 | A * | 1/1999 | Schulze | 241/30 |
| 6,474,198 | B2 * | 11/2002 | Lowther | 81/27 |
| 6,829,966 | B1 * | 12/2004 | Bramuchi | 81/26 |
| 7,300,006 | B2 * | 11/2007 | Weisbeck | 241/63 |
| 2011/0182770 | A1 * | 7/2011 | Chandrapati et al. | 422/28 |

* cited by examiner

*Primary Examiner* — Mark Rosenbaum
(74) *Attorney, Agent, or Firm* — Charles A. Wilkinson; Clinton H. Wilkinson

(57) ABSTRACT

A pill or tablet fracturing set including a striking device, a pill support board upon which the pill or tablet is struck by the striking device using a control grip, and a supply of transparent pill retentive bags to contain the pills while being struck.

10 Claims, 3 Drawing Sheets

PILL CRUSHING DEVICE AND SYSTEM

CLAIM OF PRIORITY

This application claims the benefit of U.S. Provisional Application No. 61/580,976, filed Dec. 28, 2011, entitled Pill Crushing Device and System.

FIELD OF THE INVENTION

The present invention is directed to devices for crushing or pulverizing tablets or pills into a powder form, and more particularly to a handheld portable tablet or pill crushing or pulverizing device, and more particularly still to a system and kit for quickly and easily manually crushing and pulverizing individual or small numbers of tablets or pills at a time.

BACKGROUND OF THE INVENTION

Generally speaking, the most effective and the least expensive means and method for manufacturing and dosing medications is in a solid pill form. To those of ordinary skill in the art, the term "pill" commonly refers to pharmacological oral doses of active ingredient(s) in solid form. Unfortunately, there are several potential problems associated with the administration of this particular medium of medication. Problems include patients with strong gag reflexes or impaired swallowing ability due to various medical conditions, swallowing disorders associated with aging, impaired mental status, altered levels of consciousness, fear of choking mediated reactions, and a general difficulty in swallowing pills as a whole. As a more specific example, any pills must of necessity be crushed if the individual must use a so-called PED, or percutaneous endoscopic gastrostomy tube. In addition, many healthy people have trouble swallowing pills such as vitamins, particularly multivitamins and the like frequently having a relatively large diameter. In fact, the ability to swallow large solid masses of anything is principally a learned reaction which does not conform well with an untrained body's natural reflexes.

Traditional means of pill crushing has involved the use of a mortar and pestle. Similarly, nurses and other medication dispensing personnel frequently resort to the use of hammers or mallets used in combination with bowl-like containers. Typically, the striking head of a hammer is positioned at a right angle with respect to the handle, and it is brought downwardly following a generally arcuate path into contact with the top surface of the item to be broken into pieces or crushed.

There are several disadvantages to both the mortar and pestle and hammer techniques of crushing pills. One disadvantage is that both techniques require a significant amount of manual force from the user to achieve the desired pill crushing effect. In particular, the conventional hammer is designed to provide a maximum amount of striking force, much more than is required to split and then crush a typical pill or tablet to be ingested. In addition, unless the user has practiced using a hammer or mallet, or has unusually good hand eye coordination, he or she will likely have surprisingly poor aim and control of the hammer, particularly where attempting to hit a small pill or tablet.

Another disadvantage of both prior techniques is that the mortar and pestle, or hammer and bowl-like container must be thoroughly cleaned and dried after each use to prevent subsequent pills pulverized by the mortar and pestle, or hammer and bowl, from being contaminated by residue from the previous medications with which it was used. Additionally, both techniques are susceptible to having remnants of the medication fly out of the mortar or bowl-like container which can lead to improper dosing and can potentially result in serious injury. Also, the hammer technique in particular creates loud noises which often irritate the user, or nearby persons, pets or animals.

In addition to the mortar and pestle, and hammer methods, various medication, tablet, and/or pill cutting, pulverizing, or crushing devices are known and available for purchase. Known pill or tablet crushing devices generally include a first means for supporting or holding a pill or tablet to be crushed, and another means such as a lever for pressing or exerting a force on one side of the pill or tablet great enough to crush and then pulverize it. Most of such known devices are relatively expensive, costing up to $100 or more, and as a result are not practical for home use or purchase by the average consumer. Further, some devices do not crush or pulverize the pill material into sufficiently small or fine particles. For example, where a feeding tube has been inserted directly into the stomach, the pill material must be passed through the feeding tube. Thus, the particles must be fine enough so they do not clog the feeding tube, which is very inconvenient and uncomfortable for the patient since the feeding tube must be removed or otherwise replaced or cleaned prior to continued use. A drawback of some other pill crushing devices is that the user's view of the tablet or pill as it is being crushed or pulverized is obstructed as it is held between a pair of metal plates or the like as they are brought together. Persons having vision problems or at least imperfect vision may also have trouble seeing the crushed tablet or pill material clearly enough to visually discern whether or not it is completely or sufficiently rendered into a powder form. The weight of a hammer is generally too great to allow for any probing of the pill material for uncrushed pieces, and using one's fingers is objectionable as this may contaminate the pill material. There is therefore a need for a tablet or pill crushing or pulverizing system and apparatus that is inexpensive and easy to use, and wherein the user can see the pill or tablet as it is being crushed.

BRIEF SUMMARY OF THE INVENTION

It is an object of the invention to provide a means and system for pill crushing or pulverizing that is cost-effective, energy-efficient, simple to use, and easy to clean.

It is further an object of the invention to provide a pill crushing or pulverizing device that is portable and does not require a sizeable area to operate said device.

It is further an object of the invention to avoid the visual obstruction of the pill crushing surface during use of the device, thereby allowing the user to easily see and monitor the pills being crushed.

It is further an object of the invention to provide a device that does not require unusually advanced hand-eye coordination to use and does not require a great amount of manual force to be applied.

It is further an object of the invention to provide a means of crushing more than one pill at a time.

The invention, in one form thereof, is directed to a pill crushing device for use in crushing a pill or pills. The pill crushing device includes a cylindrical, weighted rod having a flat, circular surface on at least one end, and preferably both ends. The circumference of the weighted rod is wrapped in a material that is grippable yet smooth enough to allow for easy glidability of the device through the fingers of a person gripping the device.

The invention, in another form thereof, is directed to a pill crushing system for use in crushing a pill or several pills. The system comprises the pill crushing device described above and also includes a handheld, easy to clean, pill board. The system further includes small plastic bags, whereby the pills to be crushed are placed within said bags and then placed atop the pill board. The pills are then crushed by holding the flat end of the device several inches above the pills and then releasing the device such as to allow gravity and the weight of the device to crush the pills. To fully pulverize the pills, the technique of holding the device above, then releasing it on the pills should be repeated until the desired effect is achieved. Such so-called gravity crushing or pulverizing is good for small and/or fairly soft pills. Large and/or hard pills, however, may require an actual forceful blow and perhaps a further grinding force to be applied to the pill by the end of the device in-line with the device.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following description of the preferred embodiment(s) is merely exemplary in nature and is in no way intended to limit the invention, its application, or uses.

As used throughout this specification and the appended claims, the term "weighted rod" or "rod" broadly refers to rods having a particular weight or meeting a certain threshold weight requirement suitable for use in accordance with the present invention. Weighted rods can be constructed of some solid material whereby the density of the material is uniform throughout the rod. Alternatively, weighted rods can be constructed in such a manner that the ends of the rods are made heavier than the body of the rod. The weighted rods having heavier ends are not limited to any particular internal structure, and can be, but are not limited to having, a solid, hollow, or partially hollowed configuration. After the pill is initially "crushed", the weighted rod can be physically forced against the partially fractured pieces to further fracture or "grind" the pieces by vertically applied pressure.

Figure 1:
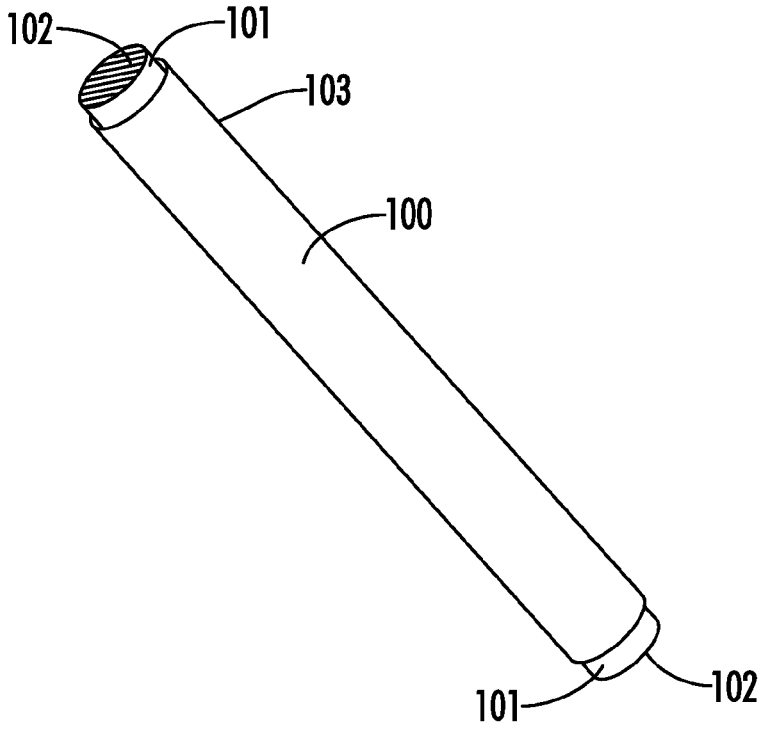
FIG. 1 is a side view of the pill crushing device in an embodiment of the present invention.

Referring now to the drawings, and more particularly initially to FIG. 1, the pill striking device 100 comprises an elongated cylindrical weighted rod 101 having flat ends 102 and a seamless polymer material 103 which encases and stretches over the circumference of the rod 101. The flat ends 102 of the rod 101 have a planar, circular surface which is perpendicular to the longitudinal axis of rod 101 and form a striking surface. The seamless polymer material is preferably attached to the rod by virtue of its tight or frictional fit over the rod's circumference.

In one embodiment of the invention, the polymer material 103 is heat shrunk over the rod 101 to achieve the tight fitting configuration. Heat shrinking also allows for the edges of a stretch of polymer material to be sealed together and attached without the need of another attaching means thereby eliminating the presence of seams in the final, fitted product. The presence of seams presents the disadvantage of disrupting the desirable smooth finish of the polymer material, which in turn affects the glidability of the pill striking device between the user's fingers during use of the invention. The slip or Coefficient of Friction (CoF) between the outer surface of the cover material and the user's hand should be such that the dynamic Coefficient of Friction allows the pill striking device to continue sliding downwardly in the hand of the user due to its own weight and force of gravity once such sliding is initiated and assuming a constant grip force applied on the cover by the user. A preferred polymer material is a polyolefin material. One such polyolefin material is a flexible heat shrinkable polyolefin adhesive-lined tubing available from 3M Corporation.

In a preferred embodiment of the present invention, the pill striking device 100 has a mass of at least five ounces. It is also preferred that the pill striking device have a length of about 5¾ inches which will conveniently fit into a box that is approximately 6 inches in length. It is also preferred that the pill striking device have a radius of about ¼ inches, or a diameter of about ½ inches, which makes the device convenient to hold and manipulate. The rod of the pill striking device may be composed of solid steel having a uniform density throughout the rod. Alternatively, the rod may be constructed in such a manner that its ends are made heavier than the body of the rod by having a more massive material embedded within the ends of the rod.

Figure 2:
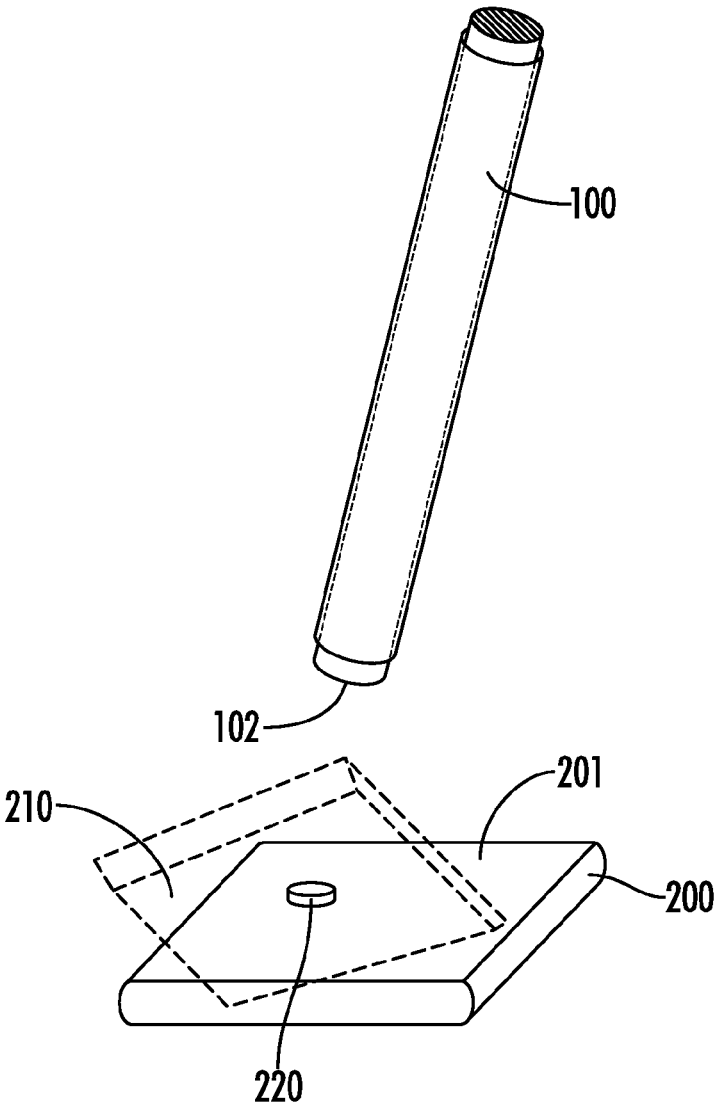
FIG. 2 is a side view of the pill crushing system in an embodiment of the present invention.

FIG. 2 illustrates the basic pill crushing system of the invention comprising a pill striking device or fracturing implement 100, pill board 200, and a plastic transparent pill retentive bag 210 according to one embodiment of the invention. In accordance with this embodiment, the system is made ready for use by laying the pill board 200 on a flat and preferably horizontal surface, with one of the flat surfaces 201 of the pill board facing upward. Next, a subject pill to be crushed 220 is placed in and enclosed within the pill retentive bag 210, and then the subject pill 220 within the pill retentive bag 210 is placed at the center of the flat surface 201. As shown by FIG. 2, one of the flat ends 102 of the pill striking device 100 is held above the subject pill 220. The pill striking device 100 is then released from several inches over the pill repeatedly until the desired pill crushing or pulverizing effect is achieved. As indicated above, for particularly large or hard pills, the device may be physically driven downwardly to forcefully strike the pill.

The cylindrical striking device or implement 100 of the invention has been found to be particularly useful in fracturing and crushing small fragile items such as pills or tablets and the like because of the superior control attained in the striking movement which takes place in a very restricted area with the entire weight of the device or striker implement directly behind the flat end or striking head. Thus all the force contributed to the striking head is lined up directly behind the striking head and induces the striking force of the implement which helps to control and correct the blows of the head directly into a fracturing force upon the large aggregates of material to be crushed, and the blows can be directed very precisely against the aggregate to be fractured increasing the accuracy of the pill fracturing operation. Since pills are largely aggregates of smaller particulates furthermore which have frequently been aggregated together by pressure applied to unconsolidated materials in a die, such consolidated materials can often be most efficiently fractured into pieces again or broken apart by repeated force directed accurately against the consolidated material with only minor variations in the applied force. Thus each blow if more or less accurately aligned with previous fracturing blows will prove to be more disruptive of the material struck than with blows struck with different angles of striking force. The cylindrical striking device or implement of the invention, therefore, has a greater disruptive effect upon the consolidated pills than does a hammer or striking implement which is held by a so-called "power grip" such as a regular hammer head. The elongated cylindrical striking device or implement of the present invention is held in the traditional "control grip" of the human hand and yet can provide not only a powerful blow, but a relatively accurate blow.

The pill board 200 should be sturdy and composed of a hard, non-brittle material. The pill board may be small enough to be adapted for handheld use. In a preferred embodiment, the pill board preferably has the approximate dimensions of 2⅝ inches square in lateral dimensions with a thickness of ⅝ inches and is solidly composed of Corian®.

In an embodiment of the present invention, the plastic pill retentive bags 210 are adapted to be placed upon or fit over the pill board and are intended for single use, or multiple use if the same pill material is being consecutively crushed. The bags also have a mechanism for sealing the opening of the bag tightly shut. The bags are also clear in color thereby allowing visibility of the bag's contents. In addition to preventing cross contamination of medications, the pill retentive bags also serve to decrease or eliminate the need for washing the pill board and hammer after each use. The pill retentive bags also allow the pills to be struck with greater accuracy as they help keep the pills from rolling or slipping off the surface of the pill board prior to or during the use of the invention. Additionally, because the bags are clear or clear enough to be readily seen through, the user is able to monitor his or her aim at the pills by the hammer as well as the progress of pulverization of the pills which is quite important if a thorough job is to be performed.

Figure 3:
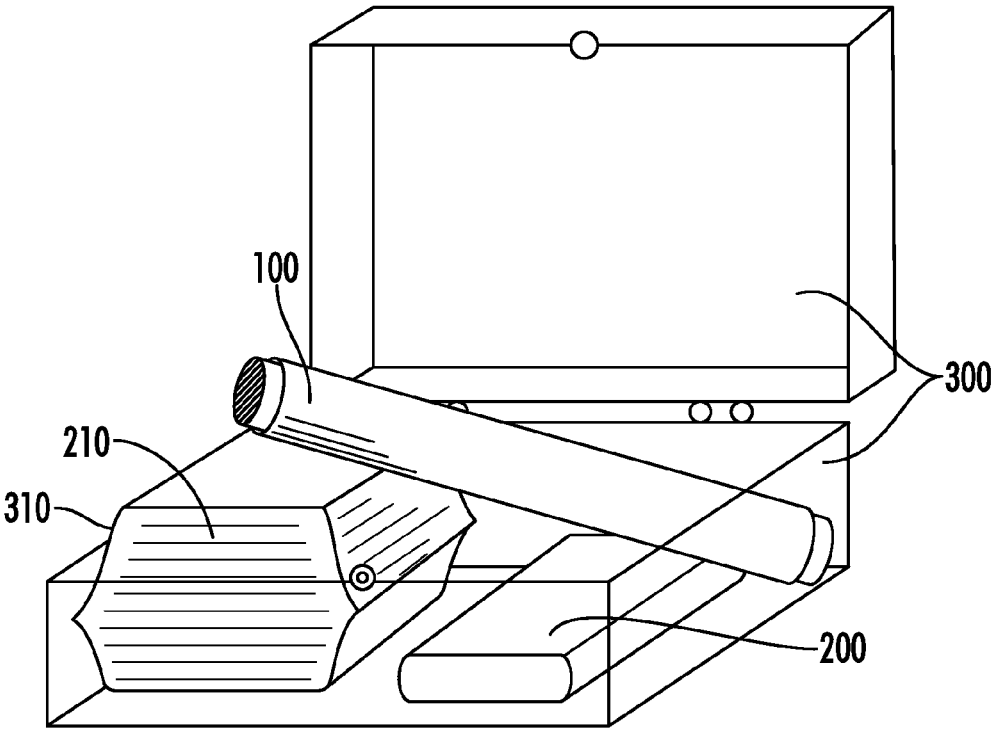
FIG. 3 shows the pill crushing system kit in an embodiment of the present invention.

FIG. 3 depicts a pill crushing system kit in accordance with the present invention. The kit includes a carrying case 300, a pill striking device 100, a pill board 200, a package 310 of pill retentive bags 210, and a pamphlet (not shown) containing product information and directions on how to use the pill crushing system. Case 300 may also be zippered cloth bag or other holder.

The striking device or implement of the present invention as explained above is essentially a preferably elongated weighted section which is preferably round in conformation such as an elongated round bar of metal. The length can be from about 2 to 12 inches but a length between 5 and 7 inches is preferred. A length of about six inches has been found to be very satisfactory. The entire circumference is preferably coated as explained with a thin but durable coating of polymer preferably resilient so as to be comfortable to hold in the hand or by the grip of the fingers. The striking end surface of the device is preferably of base metal, but can be coated with a durable plastic composition which should not be too thick and is preferably more solid or resilient to impact than the polymer or plastic that coats the sides of the member. A very satisfactory construction is to have side coating not extend to the very end of the striking device on either end, but to have the side coating terminate about one eighth to one quarter of an inch from the end so as not to impact against the pill or tablet material being struck by either end. It will be understood that the polymer or so-called plastic covering the side of the striking device has the function of increasing the security of the user's grip upon the device and should enable the user to securely, but easily, grip and maintain control of the implement with his or her fingers while not being detrimental to the skin of the hand and fingers or being sticky, so that the striking device is easily slidable between the user's fingers while still being easily grippable and controllable. The polymer coating on the end or striking surface of the device has the function of shielding the weighted rod material from the pill or tablet material being struck. This being so, it will be understood that any polymer or plastic coating applied to the end of the striking implement of the invention need not be used on such end, but is used in an embodiment of the invention. Consequently, it will be understood that the end of the implement of the invention can also be merely composed of the base metal, although it should be readily understood that it should not be frangible metal which might chip off and contaminate the crushed pill material.

In the use of the striking device of the invention, such implement which is, as explained elsewhere, held not in the palm of the hand in the so-called power grip of the human hand, but by the so-called control grip where the important thing is that close control of the impact and more particularly the angle, force and rapidity of the impact be easily controlled by the one wielding the device. Pill material, which is usually originally composed of small grains of individual powder which are compacted together by external pressure during manufacture, usually in an opening of a die where the material is gathered and exposed to increasing pressure which in effect crushes together and consolidates the individual pieces into a more or less consolidated whole, and fairly frequently of varying materials which are compacted together to provide a unitarily compacted material having an average composition which is remarkably uniform from one pill or composition to another.

When striking such conglomerates or consolidates, however, the consolidated pill or tablet does not always fracture in the same manner so that one tablet may fracture in one manner and the next tablet may fracture in a different manner. Thus, in one embodiment second or succeeding blows may be desired to be with slightly different trajectories, so the second strike of a series of strikes or blows may be made in a slightly different direction and from a slightly different angle so as to most effectively crush the components resulting from the prior blow or blows. Of course, holding the tablet or pill in a plastic membrane while fracturing decreases the different trajectories of the pieces when impacted. However, significant displacement of individual pieces may still occur. It is rather important, therefore, that the one using the striking device use a control grip so as to maintain good control of the striking device of the invention. A light control grip of the striking device should, therefore, be maintained and preferably it will usually be held by almost the same control grip as a pencil is frequently held, although with the striking device held closer to vertical than the usual grip applied to a pencil.

As indicated, it is important that an efficient crusher of pills or capsules use an efficient control grip; however, because the usual variation of fracturing pattern between capsules may be easily altered, and therefore the enablement of a rapid and efficient controlled blow upon the material to be crushed becomes even more important. It has been found by the present applicant that striking device which has all its weight distributed along an elongated straight rod configuration becomes even more important. No other implement or arrangement is so quick and accurate, as well as effective, in crushing of the usual consolidated pill and capsule structures. In many cases, it may even be found that efficient crushing may even be obtained without the necessity of using the plastic crushing bag of the invention.

Because of the elongated balanced configuration of the striking device or fracturing implement of the invention, often it will be desired to allow the device or implement to fall of its own weight upon the pill or capsule which is to be fractured, in which case the striking device is repetitively grasped and lifted and then allowed to fall upon the material to be fractured while guiding it generally with the fingers held loosely about it in a position to immediately grip it and raise it again for another blow. In this manner, the consecutive impacts can be made more uniform since they are essentially made entirely as a result of a fracturing blow applied by the force of gravity acting upon the striking device. The polymer material 103 which encases the circumference of the striking device allows the device to easily slide in the user's fingers. The pill or tablet pulverizing apparatus and method of the present invention has been found to be extremely efficient and effective in the fracturing of pills and tablets for those who cannot, for one reason or another, handle swallowing the normal size of the particular pill or tablet and for one reason or another do not wish to, or cannot, ingest the material dissolved in water or the like.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A pill crushing system comprising:

a) a pill fracturing implement comprised of an elongated, cylindrical weighted rod having flat end surfaces, and having a tightly fit, seamless, polymer material jacket disposed about the outer circumference of the rod;

b) a pill board having a flat planar top surface, and flat planar bottom surface; and c) a pill retentive bag adapted to contain a subject pill to be crushed by blows struck by the rod.

2. The pill crushing system of claim 1 with the pill board having dimensions of about 2¾ inches by about 2¾ inches by about ½ inches.

3. The pill crushing system of claim 1 with the pill board having dimensions of about 3 inches by about 3 inches by about ½ inches.

4. The pill crushing system of claim 1 with the pill board having a composition of Conan®.

5. The pill crushing system of claim 1 additionally comprising:

d) a pamphlet containing product specifications and directions of use; and e) a carrying case.

6. The pill crushing system of claim 1 in which the cylindrical rod has a length of between about 5 and about 7 inches, and a radius of between about ¼ of an inch and about ⅝ of an inch.

7. The pill crushing system of claim 1 with the rod having a mass of at least between about 5 ounces and 7 ounces, said weight being more or less equally distributed throughout the rod.

8. The pill crushing system of claim 1 in which the polymer material jacket is a heat shrinkable polyolefin.

9. The pill crushing system of claim 1 in which the coefficient of friction between the hand of a user gripping the rod and the polymer jacket material is such that when the force applied by the hand on the polymer jacket material is reduced so that the rod slides downwardly in the user's hand due to its own weight, the rod will continue sliding downwardly into contact with a pill to be fractured by the rod.

10. A method of crushing pills and capsules using a structurally elongated striking device with the weight concentrated in a relatively narrow elongated striking element comprising:

a) gripping the structurally elongated striking device in one hand using a control grip, with the elongated striking device in a substantially vertical orientation and positioned a distance less than the length of the striking implement above a substantially flat pill support surface;

b) placing a consolidated material which it is wished to fracture into multiple smaller pieces into a retentive bag;

c) placing the retentive bag containing the consolidated material to be fractured on the pill support surface;

d) directing one end of the elongated striking element toward the consolidated material from directly over such material while holding the elongated striking element in said control grip;

e) regrasping the elongated striking element and if necessary altering the position of the elongated striking element appropriately so as to be directly over at least one smaller piece of consolidated material and restriking as necessary to reduce the at least one smaller piece into even smaller sections as desired; and f) repeating step (d) until the consolidated material has been sufficiently pulverized or crushed into said smaller sections.

* * * * *